US010586507B2

(12) United States Patent
Lee et al.

(10) Patent No.: US 10,586,507 B2
(45) Date of Patent: Mar. 10, 2020

(54) ANTI-FLICKER DISPLAY DEVICE

(71) Applicant: SAMSUNG DISPLAY CO., LTD., Yongin-si, Gyeonggi-Do (KR)

(72) Inventors: Jae Hoon Lee, Yongin-si (KR); Jai Hyun Koh, Yongin-si (KR); Heen Dol Kim, Yongin-si (KR); Bong Hyun You, Yongin-si (KR); Soo Yeon Lee, Yongin-si (KR); Seok Ha Hong, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 52 days.

(21) Appl. No.: 15/935,812

(22) Filed: Mar. 26, 2018

(65) Prior Publication Data

US 2018/0322844 A1 Nov. 8, 2018

(30) Foreign Application Priority Data

May 8, 2017 (KR) ..... 10-2017-0057502

(51) Int. Cl.

| | |
|---|---|
| ***G09G 3/30*** | (2006.01) |
| ***G09G 3/36*** | (2006.01) |
| ***G09G 5/10*** | (2006.01) |

(52) U.S. Cl.

CPC ..... *G09G 3/3696* (2013.01); *G09G 5/10* (2013.01); *G09G 2300/0413* (2013.01); *G09G 2320/029* (2013.01); *G09G 2320/0247* (2013.01)

(58) Field of Classification Search

CPC ... G09G 3/30; G09G 5/00; G09G 3/10; G06F 3/038

See application file for complete search history.

(56) References Cited

U.S. PATENT DOCUMENTS 7,924,041 B2 * 4/2011 No ..... G02F 1/136259 324/760.01
8,847,871 B2 9/2014 Lee et al.
9,477,339 B2 * 10/2016 Hyun ..... G06F 3/0412
(Continued)

FOREIGN PATENT DOCUMENTS

KR 10-1448006 10/2014
KR 10-1481701 1/2015
(Continued)

*Primary Examiner* — Pegeman Karimi
(74) *Attorney, Agent, or Firm* — F. Chau & Associates, LLC

(57) ABSTRACT

A display device may include display pixels configured to emit light at a luminance corresponding to a data signal, at least one auxiliary pixel configured to store an auxiliary voltage, a gate driver configured to supply a gate signal to the display pixels and the auxiliary pixel, a data driver configured to convert image data into the data signal, and supply an auxiliary voltage having a preset level to the auxiliary pixel. A sensing circuit is configured to sense a change in the auxiliary pixel for each frame, and generate compensation voltage information. A timing controller is configured to convert an image signal into the image data, and generate a driving voltage control signal. A voltage generation unit is configured to generate a driving voltage corresponding to the driving voltage control signal, and generate the reference gamma voltage based on the driving voltage.

20 Claims, 13 Drawing Sheets

(56) References Cited

U.S. PATENT DOCUMENTS

| | | | | |
|---|---|---|---|---|
| 2009/0315840 | A1* | 12/2009 | Park | G02F 1/13338 345/173 |
| 2010/0201698 | A1 | 8/2010 | Lee | |
| 2015/0194118 | A1 | 7/2015 | Lee et al. | |
| 2016/0379588 | A1* | 12/2016 | Kim | G09G 3/3696 345/214 |
| 2017/0110084 | A1* | 4/2017 | Park | G09G 3/3688 |

FOREIGN PATENT DOCUMENTS

| | | |
|---|---|---|
| KR | 10-2015-0081848 | 7/2015 |
| KR | 10-1641532 | 8/2016 |

* cited by examiner

ANTI-FLICKER DISPLAY DEVICE

CROSS-REFERENCE TO RELATED APPLICATION

The present application claims priority to Korean patent application no. 10-2017-0057502 filed on May 8, 2017, the entire disclosure of which is incorporated by reference herein.

TECHNICAL FIELD

Various embodiments of the present inventive concept relate to a display device.

DISCUSSION OF RELATED ART

With an increase in interest in a display device and an increase in demand to use portable information media, research on display devices and commercialization thereof have rapidly progressed. The display devices may be classified according to a method of emitting light, such as a liquid crystal display device, an organic light emitting display device, a plasma display device, an electrophoretic display device, and so forth.

Since the liquid crystal display device has benefits in that power consumption is typically less than other types of display devices and implementation of a full-color video is possible, the liquid crystal display device is now widely used in mobile phones, navigation apparatuses, monitors, televisions, etc.

Generally, the liquid crystal display device may include a first substrate including a pixel electrode, a second substrate including a common electrode, and a liquid crystal layer interposed between the first and second substrates. The liquid crystal display device may adjust a voltage to be applied to the pixel electrode and the common electrode so as to vary the magnitude of an electric field formed in the liquid crystal layer. Depending on the magnitude of the electric field, the transmissivity of light passing through the liquid crystal layer may be adjusted, and the liquid crystal display device may display a desired image.

SUMMARY

Various embodiments of the present inventive concept are directed to a display device which senses a change in an auxiliary voltage stored in auxiliary pixel (e.g. a dummy pixel) and supplies an optimal data signal to a display pixel.

An embodiment of the present inventive concept provides a display device including: a plurality of display pixels configured to emit light at a luminance corresponding to a data signal; at least one auxiliary pixel configured to store an auxiliary voltage. A gate driver configured to supply a gate signal to the plurality of display pixels and the at least one auxiliary pixel; a data driver configured to convert image data into the data signal using a reference gamma voltage, and supply an auxiliary voltage having a preset value to the at least one auxiliary pixel; a sensing circuit configured to sense whether a change occurs in the preset value of the auxiliary voltage stored in the auxiliary pixel for a predetermined period, and to generate compensation voltage information; a timing controller configured to convert an image signal inputted from an external device into the image data, and generate a driving voltage control signal that controls a driving voltage in correspondence with the compensation voltage information; and a voltage generation unit configured to generate a driving voltage corresponding to the driving voltage control signal received from the timing controller, and to generate the reference gamma voltage based on the driving voltage.

In an embodiment of the inventive concept, the predetermined period may be a per-frame basis.

In an embodiment of the inventive concept, when the compensation voltage information includes a difference value between a first auxiliary voltage measured during a current frame and a reference auxiliary voltage, the timing controller may generate the driving voltage control signal for increasing the driving voltage in correspondence with the difference value.

In an embodiment of the inventive concept, when the compensation voltage information includes a difference value between a first auxiliary voltage measured during a current frame and a second auxiliary voltage measured during a preceding frame, and the first auxiliary voltage is less than the second auxiliary voltage, the timing controller may generate the driving voltage control signal for increasing the driving voltage in correspondence with the difference value.

In an embodiment of the inventive concept, the voltage generation unit may generate an increased driving voltage from a subsequent frame.

In an embodiment of the inventive concept, when the compensation voltage information includes a difference value between a first auxiliary voltage measured during a current frame and a second auxiliary voltage measured during a preceding frame, the first auxiliary voltage is less than the second auxiliary voltage, and the difference value is greater than a threshold difference value, the timing controller may generate the driving voltage control signal for increasing the driving voltage in correspondence with the difference value.

In an embodiment of the inventive concept, the sensing circuit may include an output sensing unit configured to measure the auxiliary voltage stored in the auxiliary pixel using leakage current outputted from the auxiliary pixel; and a compensation unit configured to generate the compensation voltage information based on a change in the measured auxiliary voltage.

In an embodiment of the inventive concept, the auxiliary pixel may include a first transistor including a gate electrode coupled to an i-th (i is a natural number) gate line, a first electrode coupled to a first node, and a second electrode electrically coupled to the sensing unit through a read-out line; a second transistor including a gate electrode coupled to an i+1-th gate line, a first electrode coupled to the first node, and a second electrode coupled to an auxiliary data line; and an auxiliary capacitor coupled to the first node and configured to store the auxiliary voltage.

In an embodiment of the inventive concept, the auxiliary capacitor may store the auxiliary voltage supplied to the first node from the auxiliary data line while the second transistor is turned on.

In an embodiment of the inventive concept, the display pixels and the auxiliary pixel may be disposed on different horizontal lines.

In an embodiment of the inventive concept, the gate driver may include first and second gate drivers. The first gate driver may be coupled to the display pixels through a first gate line, and the second gate driver may be coupled to the auxiliary pixel through a second gate line different from the first gate line.

In an embodiment of the inventive concept, the display pixels may be disposed on a display area in which an image is displayed, and the auxiliary pixel may be disposed on a non-display area in which an image is not displayed.

In an embodiment of the inventive concept, a period of time in which the data signal is supplied to the display pixels may not overlap a period of time in which the auxiliary voltage is supplied to the auxiliary pixel.

An embodiment of the present inventive concept provides a display device including: display pixels configured to emit light at a luminance corresponding to a data signal; at least one auxiliary pixel configured to store an auxiliary voltage; a gate driver configured to supply a gate signal to the display pixels and the auxiliary pixel; a sensing circuit configured to sense a change in the auxiliary voltage stored in the auxiliary pixel for each frame, and generate compensation voltage information; a timing controller configured to change a gradation of an image signal inputted from an external device according to the compensation voltage information, and generate image data; and a data driver configured to convert the image data into the data signal, and supply an auxiliary voltage having a preset level to the auxiliary pixel.

In an embodiment of the inventive concept, when the compensation voltage information includes a difference value between a first auxiliary voltage measured during a current frame and a reference auxiliary voltage, the timing controller may generate image data having a gradation higher than the gradation of the image signal in correspondence with the difference value.

In an embodiment of the inventive concept, when the compensation voltage information includes a difference value between a first auxiliary voltage measured during a current frame and a second auxiliary voltage measured during a preceding frame, and the first auxiliary voltage is less than the second auxiliary voltage, the timing controller may generate image data having a gradation higher than the gradation of the image signal in correspondence with the difference value.

In an embodiment of the inventive concept, when the compensation voltage information includes a difference value between a first auxiliary voltage measured during a current frame and a second auxiliary voltage measured during a preceding frame, the first auxiliary voltage is less than the second auxiliary voltage, and the difference value is greater than a threshold difference value, the timing controller may generate image data having a gradation higher than the gradation of the image signal in correspondence with the difference value.

In an embodiment of the inventive concept, the auxiliary pixel may include a first transistor including a gate electrode coupled to an i-th gate line, a first electrode coupled to a first node, and a second electrode electrically coupled to the sensing unit through a read-out line; a second transistor including a gate electrode coupled to an i+1-th gate line, a first electrode coupled to the first node, and a second electrode coupled to an auxiliary data line; and an auxiliary capacitor coupled to the first node and configured to store the auxiliary voltage.

In an embodiment of the inventive concept, the display pixels may be coupled to first to i−1-th gate lines, and the auxiliary pixel may be coupled to the i-th and i+1-th gate lines.

In an embodiment of the inventive concept, the sensing unit may generate first auxiliary voltage information using an auxiliary pixel coupled to i-th and i+1-th gate lines, and the timing controller may generate the image data by changing a gradation of the image signal corresponding to the display pixels coupled to the i-th and i+1-th gate lines according to the first auxiliary voltage information.

In an embodiment of the inventive concept, the gate driver may include first and second gate drivers. The first gate driver may be coupled to the display pixels through a first gate line, and the second gate driver may be coupled to the auxiliary pixel through a second gate line different from the first gate line. In an embodiment of the inventive concept, the timing controller generates image data of an R_DATA, G_DATA and B_DATA having a changed gradation by changing bits of image signals R, G and B that are digital signals.

In an embodiment of the inventive concept, the compensation voltage information is stored in a look-up table.

In an embodiment of the inventive concept, a method for preventing flicker in a liquid crystal display device, the method may include providing in a display area of the liquid crystal display device, a plurality of display pixels that emit light at a luminance corresponding to a data signal of a current frame, and in at least one of a non-display area and display area of the liquid crystal display device, at least one auxiliary pixel that stores an auxiliary voltage; converting an image signal inputted from an external device into image data, and generating a driving voltage control signal that controls a driving voltage in correspondence with a compensation voltage information provided by a sensing circuit that is connected at least with the at least one auxiliary pixel and a timing controller; comparing a leakage current of at least one auxiliary pixel during a previous frame with a leakage current of the current frame, in which the auxiliary pixel is configured to store an auxiliary voltage; and adjusting a compensation voltage that is applied to a voltage generation unit, when the comparing of the leakage current indicates that the luminance of the plurality of the display pixels is outside of a threshold range.

The adjusting of the compensation voltage may occur in real time during a frame.

The compensation voltage may restore the luminance of the plurality of display pixels to a value initially specified by the data signal of the current frame.

In an embodiment of the inventive concept, a non-transitory computer readable storage medium includes executable code when executed by a processor of a display device performs the above-described method of the inventive concept.

BRIEF DESCRIPTION OF THE DRAWINGS

Example embodiments of the inventive concept will now be described more fully hereinafter with reference to the accompanying drawings. However, a person of ordinary skill should understand and appreciate that the inventive concept may be embodied in different forms and should not be construed as limited to the embodiments set forth herein. Rather, these embodiments are provided for illustrative purposes so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
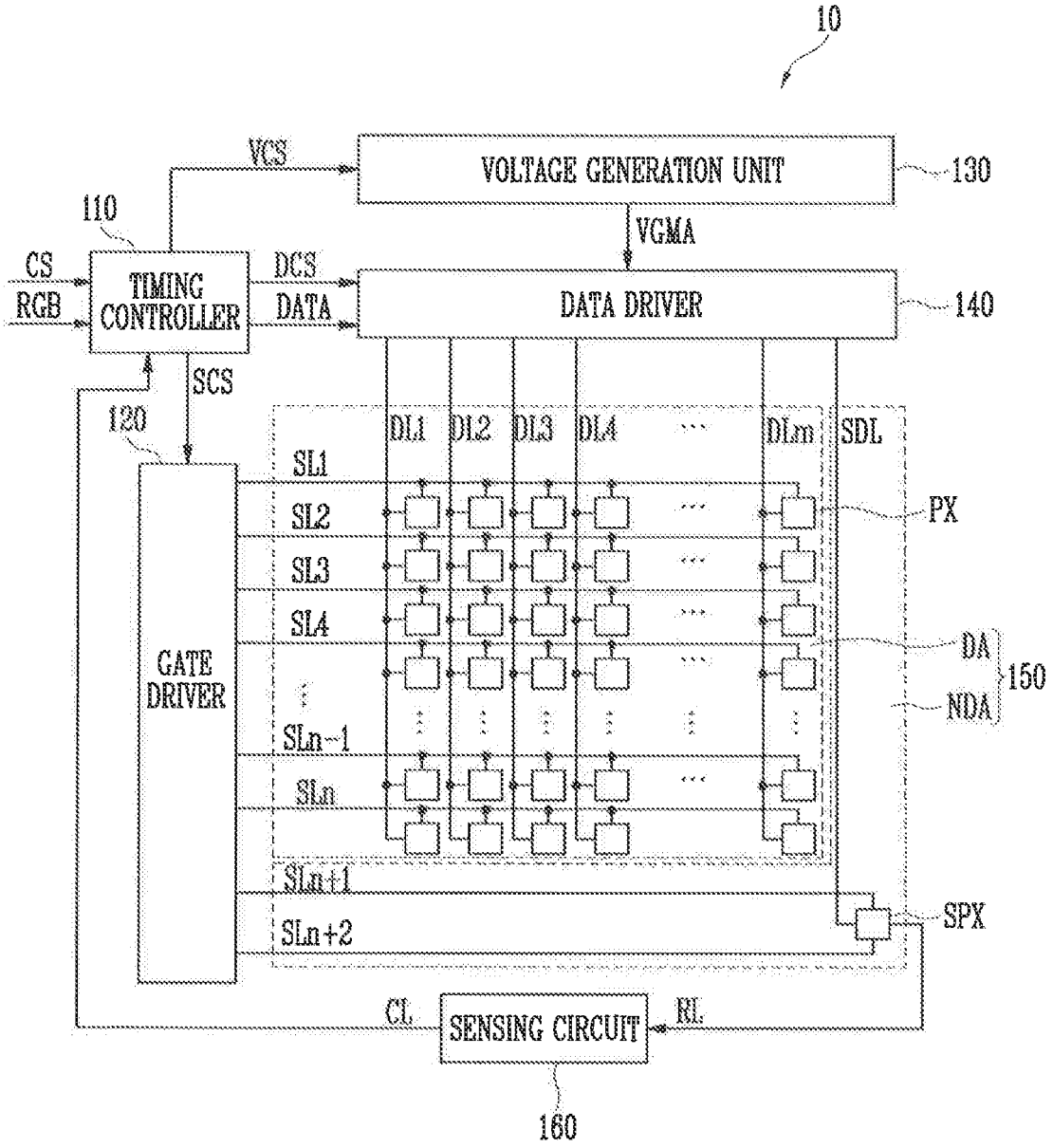
FIG. 1 is a block diagram schematically illustrating a display device according to an embodiment of the present inventive concept.

Hereinafter, one or more embodiments of the inventive concept will be described in greater detail with reference to the accompanying drawings. Embodiments are described herein with reference to cross-sectional illustrations that are schematic illustrations of embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but may include deviations in shapes that result, for example, from manufacturing. In the drawings, lengths and sizes of layers and regions may be exaggerated for clarity. Like reference numerals in the drawings denote like elements.

Terms such as 'first' and 'second' may be used to describe various components, but they should not limit the various components. Those terms are only used for the purpose of differentiating a component from other components. For example, a first component may be referred to as a second component, and a second component may be referred to as a first component and so forth without departing from the spirit and scope of the present disclosure. Furthermore, 'and/or' may include any one of or a combination of the components mentioned.

Furthermore, a singular form may include a plural form as long as it is not specifically mentioned in a sentence. Furthermore, "include/comprise" or "including/comprising" used in the specification represents that one or more components, steps, operations, and elements exist or may be added.

Furthermore, unless defined otherwise, all the terms used in this specification including technical and scientific terms have the same meanings as would be generally understood by those skilled in the related art. The terms defined in generally used dictionaries should be construed as having the same meanings as would be construed in the context of the related art, and unless clearly defined otherwise in this specification, should not be construed as having idealistic or overly formal meanings.

In this specification, the terms "connected "coupled" refers to one component either directly coupling another component and/or indirectly coupling another component through an intermediate component. On the other hand, "directly connected/directly coupled" refers to one component directly coupling another component without an intermediate component.

Figure 2:
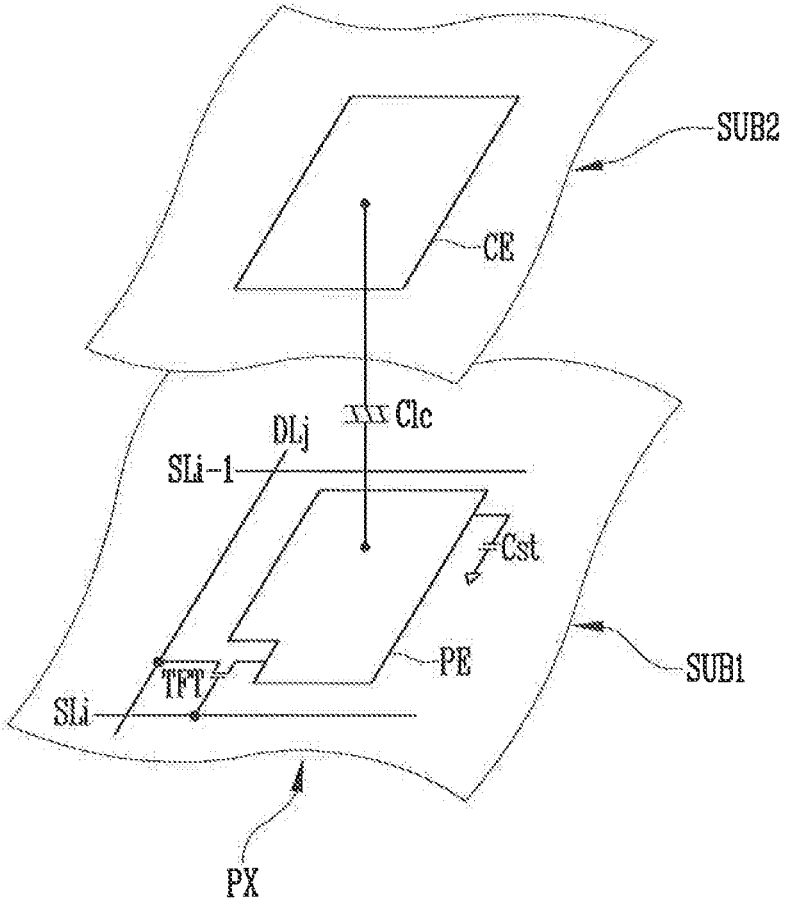
FIG. 2 is an equivalent circuit diagram illustrating a display pixel according to an embodiment of the present inventive concept.

FIG. 1 is a block diagram schematically illustrating a display device 10 according to an embodiment of the inventive concept. FIG. 2 is an equivalent circuit diagram illustrating a display pixel according to an embodiment of the inventive concept.

Referring now to FIG. 1, the display device 10 according to an embodiment of the inventive concept may include a display unit 150, a timing controller 110, a gate driver 120, a voltage generation unit 130, a data driver 140, and a sensing circuit 160.

The display unit 150 may have a display area DA in which an image is displayed, and a non-display area NDA in which an image is not displayed. The display unit 150 may include, for example, a plurality of display pixels PX and at least one auxiliary pixel SPX.

The display pixels PX may be disposed on the display area DA of the display unit 150, and the display pixels PX may be coupled to data lines DL1 to DLm and gate lines SL1 to SLn. The display pixels PX may be supplied with data signals from the data driver 140 and gate signals from the gate driver 120, through the respective data lines DL1 to DLm and the gate lines SL1 to SLn.

The display pixels PX may be arranged in a matrix form at intersections of the data lines DL1 to DLm and the gate lines SL1 to SLn.

The auxiliary pixel SPX may be disposed, for example, on the non-display area NDA of the display unit 150, and may be coupled to an auxiliary data line SDL and to gate lines SLn+1 and SLn+2. A person of ordinary skill in the art should understand and appreciate that the auxiliary pixel SPX nay be arranged in another location of the display unit 150 (e.g., a side) and there may be a plurality of auxiliary pixels.

The auxiliary pixel SPX may be supplied with an auxiliary voltage and a gate signal through the auxiliary data line SDL and the gate lines SLn+1 and SLn+2.

The auxiliary pixel SPX may store the auxiliary voltage supplied through the auxiliary data line SDL. For example, the auxiliary pixel SPX may store the auxiliary voltage during a single frame or a single horizontal period.

The timing controller 110 may translate an image signal RGB inputted from an external device into image data DATA corresponding to the specifications of the data driver 140, and then supply the image data DATA to the data driver 140.

The timing controller 110 may generate, using an external input signal CS inputted from an external device, a gate control signal SCS for controlling the gate driver 120 and a data control signal DCS for controlling the data driver 140.

The external input signal CS may include, for example, a dot clock, a data enable signal, a vertical synchronization signal, a horizontal synchronization signal, and so forth.

The timing controller 110 may be configured to provide the gate control signal SCS to the gate driver 120 and provide the data control signal DCS to the data driver 140.

The timing controller 110 may control the level of a driving voltage generated by the voltage generation unit 130 by generating a driving voltage control signal VCS including the driving voltage level and supply the generated driving voltage control signal VCS to the voltage generation unit 130.

With continued reference to FIG. 1, the timing controller 110 may generate the driving voltage control signal VCS based on compensation voltage information provided from the sensing circuit 160 for each frame. According to an embodiment of the inventive concept, the sensing circuit 160 along with the auxiliary pixel may provide to the timing controller 110. For example, in the case where the compensation voltage information includes information for increasing a driving voltage, the timing controller 110 may generate a driving voltage control signal VCS which includes information about a driving voltage having a level higher than the existing driving voltage level.

The timing controller outputs the signal SCS to the gate driver 120, and in turn, the gate driver 120 may supply gate signals to the gate lines SL1 to SLn. For example, the gate driver 120 may sequentially supply the gate signals to the gate lines SL1 to SLn.

The voltage generation unit 130 receives the driving voltage control signal VCS, and based on the VCS, may generate a reference gamma voltage VGMA that is output to the data driver. The reference gamma voltage VGMA may have a positive polarity or a negative polarity.

According to an embodiment of the inventive concept, the voltage generation unit 130 generates a driving voltage corresponding to the drive voltage level included in the driving voltage control signal VCS, and the magnitude of the driving voltage to be generated in the voltage generation unit 130 for each frame or horizontal period may be changed (e.g., adjusted). Consequently, the magnitude of the reference gamma voltage VGMA to be generated from the voltage generation unit 130 may be changed in correspondence with the magnitude of the driving voltage changing for each frame, or for a horizontal period.

The data driver 140 may generate a data signal using the data control signal DCS, the image data DATA and the reference gamma voltage VGMA. The data signal may have a positive polarity or a negative polarity.

In addition, the data driver 140 may supply data signals to the display pixels PX, in which each data signal has a positive polarity or a negative polarity through the data lines D1 to Dm.

For example, data signals each of which has a positive polarity may be applied to the display pixels PX coupled to the odd-number-th data lines (DL1, DL3, DL5, . . . ), and data signals each of which has a negative polarity may be applied to the display pixels PX coupled to the even-number-th data lines (DL2, DL4, DL6, . . . ). The positive polarity data signals and the negative polarity data signals may be inverted on a frame period basis.

The data driver 140 may supply a predetermined auxiliary voltage to the auxiliary pixel SPX through the auxiliary data line SDL. The magnitude of the auxiliary voltage may be predetermined by the data driver 140 or the timing controller 110. The magnitude of the auxiliary voltage may be fixed or changed for each frame or horizontal period. The predetermined auxiliary voltage may be a value that may update after a certain time interval, or may be a voltage value based on previous adjustments made during previous operations. The frequency of the adjustment of the output of the display pixels PX may be reduced/minimized if a current predetermined auxiliary voltage is based at least in part on previous adjustments to the auxiliary pixel SPX levels that may have been recorded in storage, e.g., a look-up table that stores previous adjustment values.

The sensing circuit 160 may measure the magnitude of the auxiliary voltage stored in the auxiliary pixel SPX using a leakage current through a read-out line RL from the auxiliary pixel SPX. The sensing unit 160 may determine a change in luminance of the display pixels PX based on a change in the auxiliary voltage measured for each frame or horizontal period.

In more detail, in the case where the driving frequency of the display device 10 is changed during successive frames, a leakage current may be generated in the display pixels PX, whereby an image having a luminance differing from the luminance of an original image may be displayed. Thus, there is a degradation in the display of an image. In the same manner as the display pixels PX, the leakage current may also be generated in the auxiliary pixel SPX.

Therefore, in the display device 100 according to an embodiment of the present inventive concept, the auxiliary voltage stored in the auxiliary pixel SPX may be measured by the sensing circuit 160 for each frame, or horizontal period, and a change in leakage current of the display pixels PX corresponding to a change in the measured auxiliary voltage may be calculated.

In an embodiment of the inventive concept, the sensing circuit 160 may sense a change in an auxiliary voltage stored in the auxiliary pixel SPX for a single frame, or sense a change in the auxiliary voltage between the frames by comparing the magnitudes of auxiliary voltages stored in the auxiliary pixel SPX with each other for each frame. The sensing circuit 160 may include, for example, comparator circuitry, a microcontroller (MCU), etc. If the change in the auxiliary voltage reaches or exceeds a predetermined threshold value, a compensation voltage may be generated to adjust the output of the display pixels PX. As the auxiliary voltage can be directed, and a compensation voltage generated, for example, on a frame or a horizontal period basis, the output of the pixels PX can be detected and adjusted in real time by sensing the change in auxiliary voltage in the auxiliary pixel. Accordingly, degradation of the display by, for example, flicker, may be prevented or eliminated.

The sensing circuit 160 may generate compensation voltage information including information about a change in the auxiliary voltage, and provide the compensation voltage information to the timing controller 110 through a compensation control line CL for each frame or horizontal period.

In FIG. 1, there is illustrated an example in which the timing controller 110, the gate driver 120, the voltage generation unit 130, the data driver 140 and the sensing circuit 160 are separately provided, but at least some of the foregoing components may be integrated with each other. For example, it is within the inventive concept that the sensing circuit 160, which may be comprised of an output sensing unit 162 and a compensation unit 164, could have one or both components integrated with the timing controller.

In FIG. 1, although there is illustrated a single auxiliary pixel SPX, a single auxiliary data line SDL, and the gate lines SLn+1 and SLn+2 coupled to the single auxiliary pixel SPX, a person of ordinary skill in the art should understand and appreciate that the inventive concept is not limited to this structure. For instance, the display device 10 according to an embodiment of the present inventive concept may further include a plurality of auxiliary pixels which may disposed on the non-display area NDA, a plurality of auxiliary data lines which may supply auxiliary data signals to the respective auxiliary pixels, and a plurality of gate lines which may be coupled to only the auxiliary data lines. While the inclusion of additional auxiliary pixels receiving auxiliary data signals and gate lines coupled only to the auxiliary data lines may increase the size of the circuitry of the display device, there may also be a more accurate sensing of TFT leakage current at different regions of the display, and thus the adjustment by the timing controller for result in enhanced display quality and prevention of the flicker phenomenon. Referring to FIG. 2, which illustrates an equivalent circuit diagram illustrating a display pixel according to an embodiment of the inventive concept, shows that each of the display pixels PX may include a thin film transistor TFT, a liquid crystal capacitor Clc and a storage capacitor Cst. A gate electrode of the thin film transistor TFT may be coupled to any one (e.g., SLi) of the gate lines SL1 to SLn, a first electrode thereof may be coupled to any one (e.g., DLj) of the data lines DL1 to DLm, and a second electrode thereof may be coupled to a pixel electrode PE and the storage capacitor Cst.

With continued reference to FIG. 2, the first electrode of the thin film transistor TFT may be set to either a source electrode or a drain electrode. The second electrode of the thin film transistor TFT may be set to an electrode different from the first electrode. For example, if the first electrode is set to a source electrode, the second electrode may be set to a drain electrode, or vice versa.

A data signal may be supplied to the pixel electrode PE disposed on a first substrate SUB1, and a common voltage may be supplied to a common electrode CE disposed on a second substrate SUB2.

With continued reference to FIG. 2, a potential difference that corresponds to a difference between a voltage of the data signal and the common voltage is generated between the pixel electrode PE and the common electrode CE. Due to the potential difference, the liquid crystal capacitor Clc is formed, and the liquid crystals are driven.

The storage capacitor Cst, when charged, may maintain the voltage of the data signal supplied to the display pixels PX for a single frame.

Figure 3:
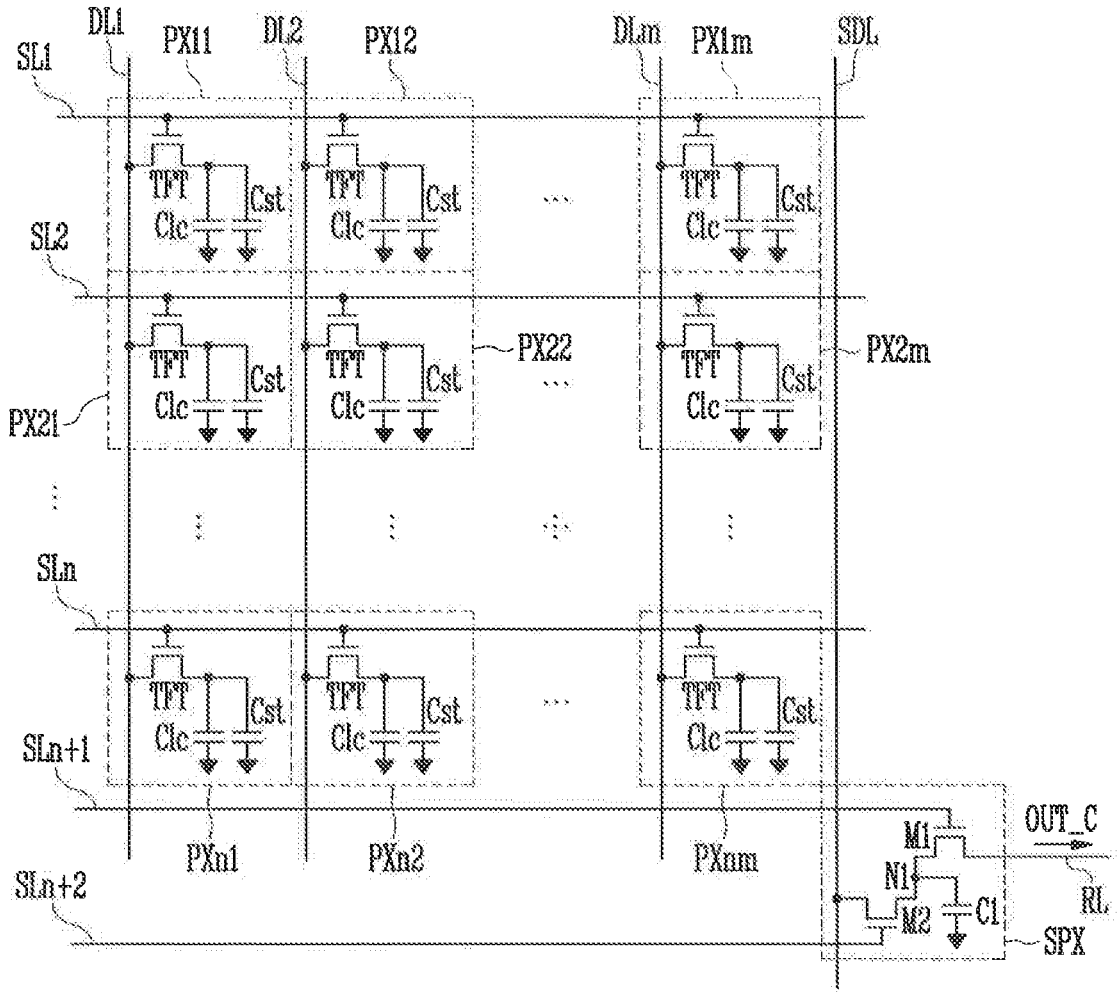
FIG. 3 is a diagram illustrating an arrangement of display pixels and an auxiliary pixel according to an embodiment of the present inventive concept.

FIG. 3 is a diagram illustrating an arrangement of display pixels PX11 to PXnm and an auxiliary pixel SPX according to an embodiment of the present inventive concept.

Referring to FIG. 3, each of the display pixels PX11 to PXnm may include a thin film transistor TFT, a liquid crystal capacitor Clc and a storage capacitor Cst. The display pixels PX11 to PXnm may be arranged in a matrix form. An artisan should understand and appreciate that the matrix of display pixels may vary in size as desired. Each of the display pixels PX11 to PXnm may receive a gate signal from any one of the gate lines SL1 to SLn, and receive a data signal from any one of the data lines DL1 to DLm.

The auxiliary pixel SPX, which can be used for determining a leakage current of the display pixels PX, may include a first transistor M1, a second transistor M2 and an auxiliary capacitor C1, and be coupled to the gate lines SLn+1 and SLn+2 and the auxiliary data line SDL.

With particular reference to the auxiliary pixel SPX shown in FIG. 3, a gate electrode of the first transistor M1 may be coupled to an n+1-th gate line SLn+1, a first electrode thereof may be coupled to a first node N1, and a second electrode thereof may be electrically coupled to the sensing unit 160 through the read-out line RL.

With continued reference to the auxiliary pixel SPX shown in FIG. 3, a gate electrode of the second transistor M2 may be coupled to an n+2-th gate line SLn+2, a first electrode thereof may be coupled to the first node N1, and a second electrode thereof may be coupled to the auxiliary data line SDL.

With continued reference to the auxiliary pixel SPX shown in FIG. 3, the first electrode of each of the first and second transistors M1 and M2 may be set to either a source electrode or a drain electrode. The second electrode of each of the first and second transistors M1 and M2 may be set to an electrode different from the first electrode. For example, if the first electrode is set to a source electrode, the second electrode may be set to a drain electrode.

The auxiliary capacitor C1 may be coupled to the first node N1, and store an auxiliary voltage. The auxiliary capacitor C1 may store an auxiliary voltage supplied to the auxiliary pixel SPX during a single frame or during a single horizontal period.

The display pixels PX11 to PXnm and the auxiliary pixel SPX may be disposed on different horizontal lines. For example, the display pixels PX11 to PXnm may be coupled to only the first to n-th gate lines SL1 to SLn, and the auxiliary pixel SPX may be coupled to only the n+1-th and n+2-th gate lines SLn+1 and SLn+2. Due to the use of different horizontal lines for the auxiliary pixels, a period in which the display pixels PX11 to PXnm are supplied with gate signals may be different from a period in which the auxiliary pixel SPX are supplied with a gate signal.

Figure 4:
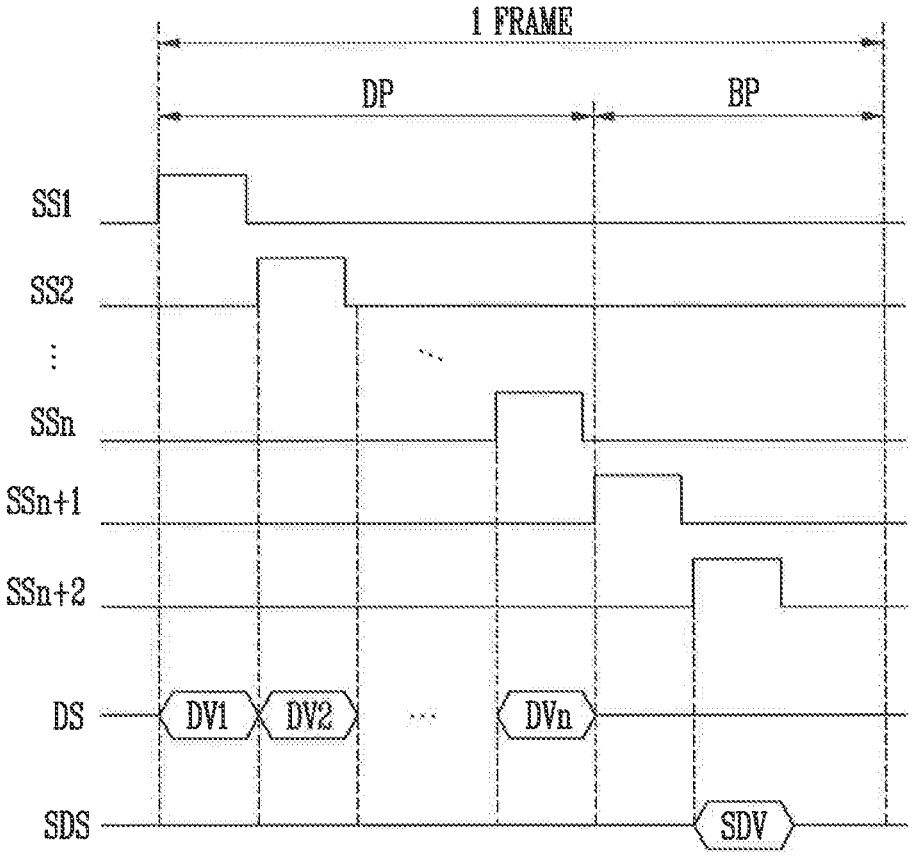
FIG. 4 is a timing diagram illustrating signals to be supplied to the display pixels and the auxiliary pixel shown in FIG. 3.

FIG. 4 is a timing diagram illustrating signals supplied to the display pixels and the auxiliary pixel shown in FIG. 3.

Referring now to FIG. 4, there are illustrated first to n-th gate signals SS1 to SSn and a data signal DS which are supplied to the display pixels PX1*m* to PXnm disposed on an m-th pixel column during one frame 1 FRAME, and there are illustrated n+1-th and n+2-th gate signals SSn+1 and SSn+2 and an auxiliary voltage SDS which are supplied to the auxiliary pixel SPX during one frame 1 FRAME. As can be seen from FIG. 4, the auxiliary pixel SPX in this example receives its signals at a different period of the 1 FRAME than the pixels PX1*m* to PXnm. In FIG. 4*m* the auxiliary pixel SPX receives its gate signals SSn+1 and SSn+2 during the blank period BP.

The first to n+2-th gate signals SS1 to SSn+2 may be supplied from the gate driver 120 (FIG. 1) through the respective first to n+2-th gate lines SL1 to SLn+2. The data signal DS may be supplied from the data driver 140 through m-th data line DLm. The auxiliary voltage SDS may be supplied from the data driver 140 through the auxiliary data line SDL.

The first to n+2-th gate signals SS1 to SSn+2 may include a voltage level used to turn on the thin film transistors TFT of the display pixels PX1*m* to PXnm, and to turn on the first and second transistors M1 and M2 of the auxiliary pixel SPX. Data voltages DV1, DV2, . . . DVn of the data signal DS to be supplied to the respective display pixels PX1*m* to PXnm may have the same value or different values.

The auxiliary pixel SPX may receive an auxiliary voltage SDS having a preset auxiliary voltage level SDV from the data driver 140.

The one frame 1 FRAME includes a data period DP for which the data signal DS is supplied to the display pixels PX1*m* to PXnm, and a blank period BP which is a pause period.

Hereinafter, with further regard to FIG. 4, the operation of the display pixels PX1*m* to PXnm and the auxiliary pixel SPX will now be described.

The display pixels PX1*m* to PXnm receive the data signal DS corresponding to the supply of the first to n-th gate signals SS1 to SSn during the data period DP.

The auxiliary pixel SPX receives the auxiliary voltage SDS from the data driver 140 during the blank period BP.

For example, with reference to FIG. 3, when the n+1-th gate signal SSn+1 is supplied to the gate electrode of the first transistor M1, the first transistor M1 is turned on. In this case, leakage current OUT_C is outputted from the auxiliary capacitor C1 to the sensing unit 160 through the read-out line RL. The term "leakage current OUT_C" refers to a current generated by an auxiliary voltage SDS stored in the auxiliary capacitor C1 for a preceding frame.

Thereafter, when the n+2-th gate signal SSn+2 is supplied to the gate electrode of the second transistor M2, the second transistor M2 is turned on. In this case, a new auxiliary voltage SDS is supplied from the data driver 140 to the first node N1, and the auxiliary capacitor C1 stores the auxiliary voltage SDS having a new auxiliary voltage level SDV.

The auxiliary capacitor C1 of the auxiliary pixel SPX may output the leakage current OUT_C to the sensing unit 160 for each frame, and store a new auxiliary voltage SDS after the leakage current OUT_C has been supplied.

In FIG. 4, there is illustrated an example in which the first to n-th gate signals SS1 to SSn are sequentially supplied to the respective display pixels PX1*m* to PXnm, but the present inventive concept is not limited to the sequential supply of gate signals. For instance, the first to n-th gate signals SS1 to SSn may be non-sequentially supplied to the respective display pixels PX1*m* to PXnm.

In FIG. 4, there is illustrated an example in which a period that a gate signal is supplied to the display pixels PX1*m* to PXnm differs from a period that a gate signal is supplied to the auxiliary pixel SPX, but the present inventive concept is not limited to this timing operation. For instance, the gate driver 120 according to an embodiment of the present inventive concept may simultaneously supply the gate signals to the display pixels PX1*m* to PXnm and to the auxiliary pixel SPX through different gate lines, during a period in which the gate signal period for the display pixels PX1*m* to PXnm and the gate signal period for the auxiliary pixel at least partially overlap each other.

Figure 5:
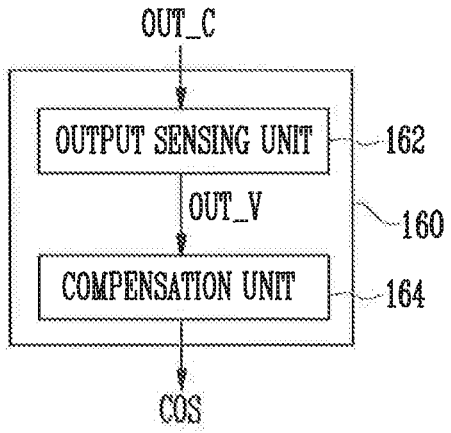
FIG. 5 is a block diagram schematically illustrating a sensing unit shown in FIG. 1.

FIG. 5 is a block diagram schematically illustrating the sensing unit 160 shown in FIG. 1.

Referring to FIG. 5, the sensing circuit 160 may include an output sensing unit 162 and a compensation unit 164.

The output sensing unit 162 may measure an auxiliary voltage OUT_V using the leakage current OUT_C outputted from the read-out line RL. The output sensing unit 162 may be embodied by a structure that performs an operation of converting inputted current into a voltage. The structure may include, for example, a transimpedance amplifier that outputs a voltage proportional to its input current. Components such as operational amplifiers, or a microcontroller, may be used. The measured auxiliary voltage OUT_V refers to a voltage that has been stored in the auxiliary capacitor C1 in a preceding frame and maintained until the current frame.

For example, an auxiliary voltage OUT_V measured by the output sensing unit 162 using leakage current OUT_C outputted during an i-th (i is a natural number) frame refers to an auxiliary voltage SDS stored in the auxiliary capacitor C1 in an i−1-th frame.

The leakage current OUT_C may be generated in the auxiliary capacitor C1 from the preceding frame to the current frame. Due to the generation of the leakage current OUT_C, the magnitude of the auxiliary voltage SDS stored in the auxiliary capacitor C1 may be changed. Consequently, the magnitude of the auxiliary voltage OUT_V measured during the current frame may differ from that of the auxiliary voltage SDS actually stored in the auxiliary capacitor C1 during the preceding frame.

When the magnitude of the auxiliary voltage SDS stored in the auxiliary pixel SPX has changed, the compensation unit 164 determines that the intensity of a data signal stored in each of the display pixels PX has also been changed. To address this change in the intensity of the data signal stored in each of the display pixels PX, the compensation unit 164 may generate compensation voltage information COS based on a change in the measured auxiliary voltage OUT_V.

In an embodiment of the inventive concept, the compensation unit 164 (of the sensing circuit 160) may calculate a difference value between the measured auxiliary voltage OUT_V and a reference auxiliary voltage, and generate compensation voltage information COS including the difference value. The reference auxiliary voltage may refer to an auxiliary voltage SDS which is actually applied to the auxiliary pixel SPX by the data driver 140.

When receiving the compensation voltage information COS including a difference value between the measured auxiliary voltage OUT_V and the reference auxiliary voltage, the timing controller 110 may determine that each display pixel PX loses a data signal DS corresponding to the difference value during a single frame. Therefore, the timing controller 110 may generate a driving voltage control signal VCS for increasing the driving voltage in correspondence with the difference value.

When the voltage generation unit 130 generates the increased driving voltage in response to the driving voltage control signal VCS received from the timing controller 110, the reference gamma voltage VGMA is generated with an increased magnitude corresponding to the increased driving voltage. Thus, there is a compensation in the display pixel PX for the leakage current of the auxiliary pixel (SPX).

Therefore, the data driver 140 may convert an image data DATA into a data signal DS using the increased reference gamma voltage VGMA, and supply the data signal DS to each display pixel PX. The data signal DS includes a loss-compensated voltage level unlike the preceding supplied data signal. Thus, even when each display pixel PX loses some data during a single frame, the display pixel PX may emit light at a desired luminance.

In an embodiment of the present inventive concept, the compensation unit 164 may calculate a difference value between a first auxiliary voltage measured during the current frame and a second auxiliary voltage measured during a preceding frame, and may generate compensation voltage information COS including the difference value.

When the timing controller 110 receives the compensation voltage information COS including a difference value between the first auxiliary voltage and the second auxiliary voltage, the timing controller 110 may determine that each display pixel PX loses a data signal DS corresponding to the difference value during a single frame. Furthermore, according to the inventive concept, the timing controller 110 may determine that the driving frequency in the preceding frame differs from the driving frequency in the current frame.

Therefore, the timing controller 110 may generate a driving voltage control signal VCS for increasing the driving voltage in correspondence with the difference value.

As described above, when the data signal DS compensated for a loss in response to the driving voltage control signal VCS is supplied to the display pixels PX, the display pixels PX may emit light at a desired luminance even when the driving frequency between frames has changed.

The loss-compensated data signal DS may be supplied to the display pixels PX for a subsequent frame.

In an embodiment of the inventive concept, the compensation unit 164 may calculate a difference value between a first auxiliary voltage measured during the current frame and a second auxiliary voltage measured during a preceding frame, and generate compensation voltage information COS including the difference value when the difference value is greater than a preset threshold difference value.

If the difference value is equal to or less than the preset threshold difference value, the compensation unit 164 may determine that there is no difference between the first and second auxiliary voltages, and generate compensation voltage information COS that does not include the difference value.

According to the inventive concept, to prevent data from being frequently compensated for when the difference is less than a threshold difference, only when the difference between the first and second auxiliary voltages has a predetermined value or more than the threshold difference may the compensation unit 164 generate compensation voltage information COS including the difference value.

Figure 6:
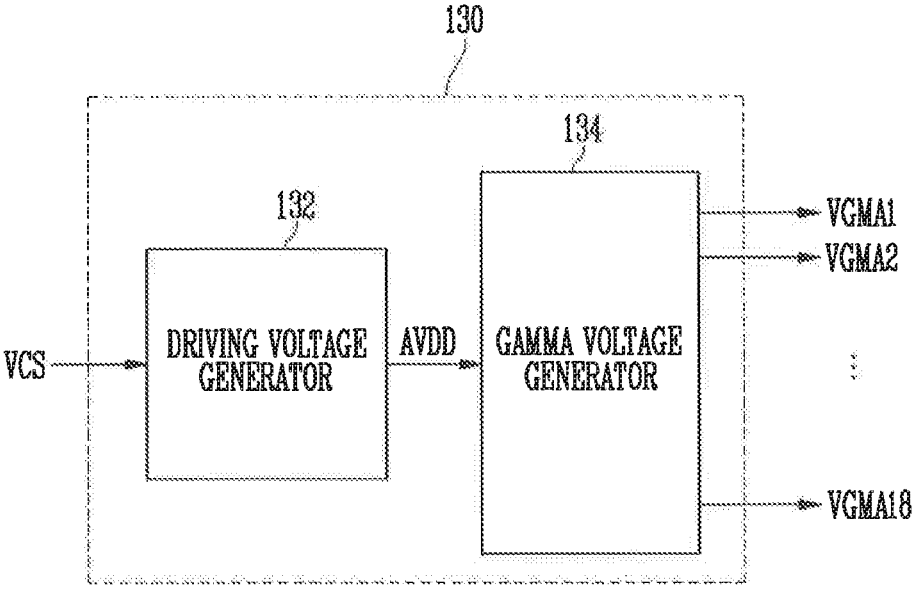
FIG. 6 is a block diagram schematically illustrating a voltage generation unit shown in FIG. 1.

FIG. 6 is a block diagram schematically illustrating the voltage generation unit 130 shown in FIG. 1.

Referring now to FIG. 6, the voltage generation unit 130 may include a driving voltage generator 132 and a gamma voltage generator 134.

The driving voltage generator 132 may generate a driving voltage AVDD based on a driving voltage control signal VCS supplied from the timing controller 110. The driving voltage AVDD may have a positive polarity or a negative polarity.

With continued reference to FIG. 6, when the driving voltage control signal VCS includes information for increasing the driving voltage AVDD, the driving voltage generator 132 may generate an increased driving voltage AVDD based on the driving voltage control signal VCS.

The gamma voltage generator 134 may generate reference gamma voltages VGMA1 to VGMA18 based on the driving voltage AVDD. The reference gamma voltages VGMA1 to VGMA18 may have different voltage levels, and each has a positive polarity or a negative polarity.

For example, the first to ninth reference gamma voltages VGMA1 to VGMA9 may have the positive polarity, and the tenth to eighteenth reference gamma voltages VGMA10 to VGMA18 may have the negative polarity. A person of ordinary skill in the art should understand and appreciate that the inventive concept is not limited to the distribution of reference gamma voltages as shown in FIG. 6.

Figure 7:
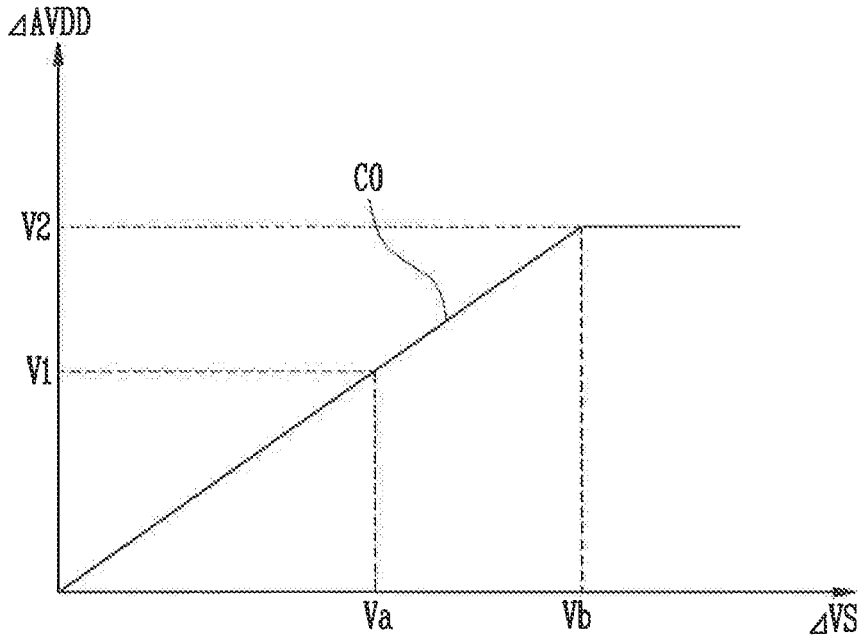
FIG. 7 is a compensation graph illustrating a method of controlling a driving voltage according to an embodiment of the present inventive concept.

FIG. 7 is a compensation graph illustrating a method of controlling a driving voltage according to an embodiment of the present inventive concept.

Referring now to FIG. 7, there is illustrated a compensation graph CO which shows the relationship between a difference value ΔVS included in the compensation voltage information COS and a driving voltage compensation value ΔAVDD. The compensation graph CO may be stored in a separate memory, a look-up table, or the like, etc.

The term "difference value ΔVS" may refer to a difference value between the measured auxiliary voltage OUT_V and the reference auxiliary voltage, or between the first auxiliary voltage and the second auxiliary voltage that have been illustrated in FIG. 5.

The timing controller 110 may determine the driving voltage compensation value ΔAVDD based on the difference value ΔVS included in the compensation voltage information COS.

For example, if a difference value between the measured auxiliary voltage OUT_V included in the compensation voltage information COS and the reference auxiliary voltage is a first difference value Va, the timing controller 110 may determine a first voltage V1 as the compensation value of the driving voltage AVDD.

Consequently, the timing controller 110 may generate a driving voltage control signal VCS which includes information about a driving voltage AVDD increased by the first voltage V1 from the existing driving voltage AVDD.

Moreover, if a difference value between the measured auxiliary voltage OUT_V included in the compensation voltage information COS and the reference auxiliary voltage is a second difference value Vb or more, the timing controller 110 may determine a second voltage V2 as the compensation value of the driving voltage AVDD.

The timing controller 110 may determine a new driving voltage AVDD using the compensation voltage information COS for each frame, and repeat a process of determining a new driving voltage AVDD until a difference value is not included in the compensation voltage information COS.

Figure 8:
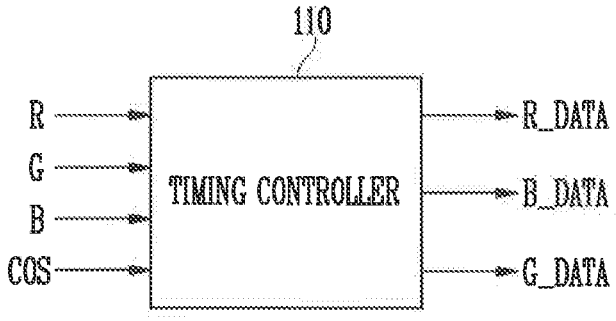
FIG. 8 is a block diagram schematically illustrating a method of generating image data by changing the gradation of image signals according to an embodiment of the present inventive concept.

FIG. 8 is a block diagram schematically illustrating a method of generating image data by changing the gradation of image signals according to an embodiment of the present inventive concept.

In the above-described embodiment of the inventive concept, there has been described a method of generating the data signal DS compensated for a loss by changing the magnitude of the driving voltage AVDD of the display pixels PX. In the present embodiment of the inventive concept, the display device 10 may generate a data signal DS compensated for a loss by changing only the gradation of image signals R, G, and B inputted from the external device, without controlling the magnitude of the driving voltage AVDD.

Referring now to FIG. 8, the timing controller 110 may generate image data R_DATA, G_DATA and B_DATA by changing the gradation of image signals R, G and B inputted from the external device, without controlling the magnitude of the driving voltage AVDD. In other words, the timing controller 110 may generate the image data R_DATA, G_DATA and B_DATA having a changed gradation by changing bits of the image signals R, G and B that are digital signals.

In detail, the timing controller 110 may change bits of the image signals R, G and B so that the gradation of the image signals R, G and B is increased in correspondence with a difference value included in the compensation voltage information COS.

For example, in the case where the timing controller 110 receives compensation voltage information COS including a predetermined difference value, and an image signal R having a gradation value "100" to be supplied to a pixel PX displaying a red color, the timing controller 110 may change the image signal R having the gradation value "100" to an image signal R having a gradation value "101" to compensate for the difference value, and convert the image signal R having the gradation value "101" into image data R_DATA having a gradation value "101". In other words, the timing controller 110 may convert the image signal R having the gradation value "100" into the image data R_DATA having the gradation value "101". Thus, the present embodiment of the inventive concept utilizes a change in gradation value rather than an increase of a driving voltage. A gradation change value of an image signal corresponding to a difference value included in the compensation voltage information COS may be previously stored in a separate look-up table. In an example, the timing controller may be configured to retrieve gradation values to change the gradation value of the R, G, B signals in response to the values sensed by the sensing unit.

As described above, according to an embodiment of the inventive concept, the timing controller 110 may change the gradation of the inputted image signals R, G and B using only the compensation voltage information COS without controlling the magnitude of the driving voltage AVDD, thereby compensating for data lost in each display pixel PX.

Figure 9:
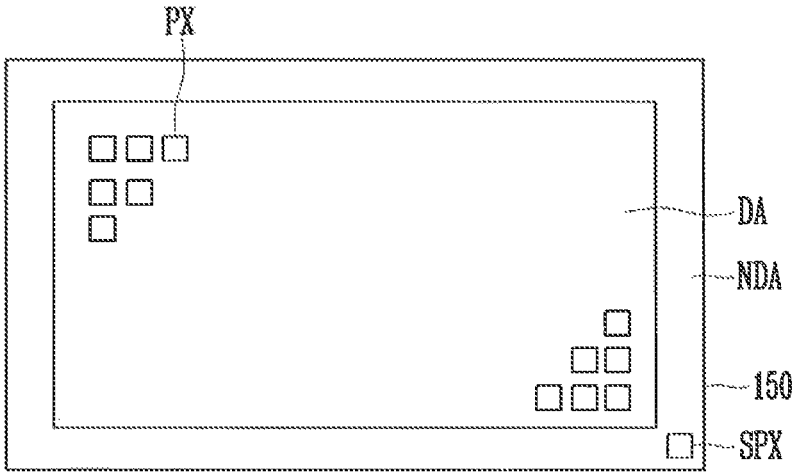
FIG. 9 is a diagram schematically illustrating a display panel according to an embodiment of the present inventive concept.

FIG. 9 is a diagram schematically illustrating a display panel according to an embodiment of the present inventive concept.

Referring to FIG. 9, the display unit 150 of the display device 10 may include a display area DA which displays an image, and a non-display area NDA.

Display pixels PX may be disposed in the display area DA, and at least one auxiliary pixel SPX may be disposed in the non-display area NDA. The auxiliary pixel is provided to determine whether the display by the pixels PX should be compensated after a frame or horizontal period.

In the example illustrated in FIG. 9, the auxiliary pixel SPX is disposed on a bottom right corner of the display unit 150, but the present inventive concept is not limited to this, and the position at which the auxiliary pixel SPX is disposed may be variously changed. For example, the auxiliary pixel SPX may be disposed on a bottom left corner or a top right corner of the display unit 150.

The auxiliary pixel SPX may be disposed on a region of the non-display area NDA, or on a plurality of regions of the non-display area NDA.

However, in an embodiment of the inventive concept, the auxiliary pixel SPX may be disposed in the display area DA. For example, the auxiliary pixel SPX may be disposed on a side portion or a central portion of the display area DA. A person of ordinary skill in the art should appreciate that the arrangement of one or more auxiliary pixels according to the inventive concept is broad, and not limited to the depictions in the drawings.

Figure 10:
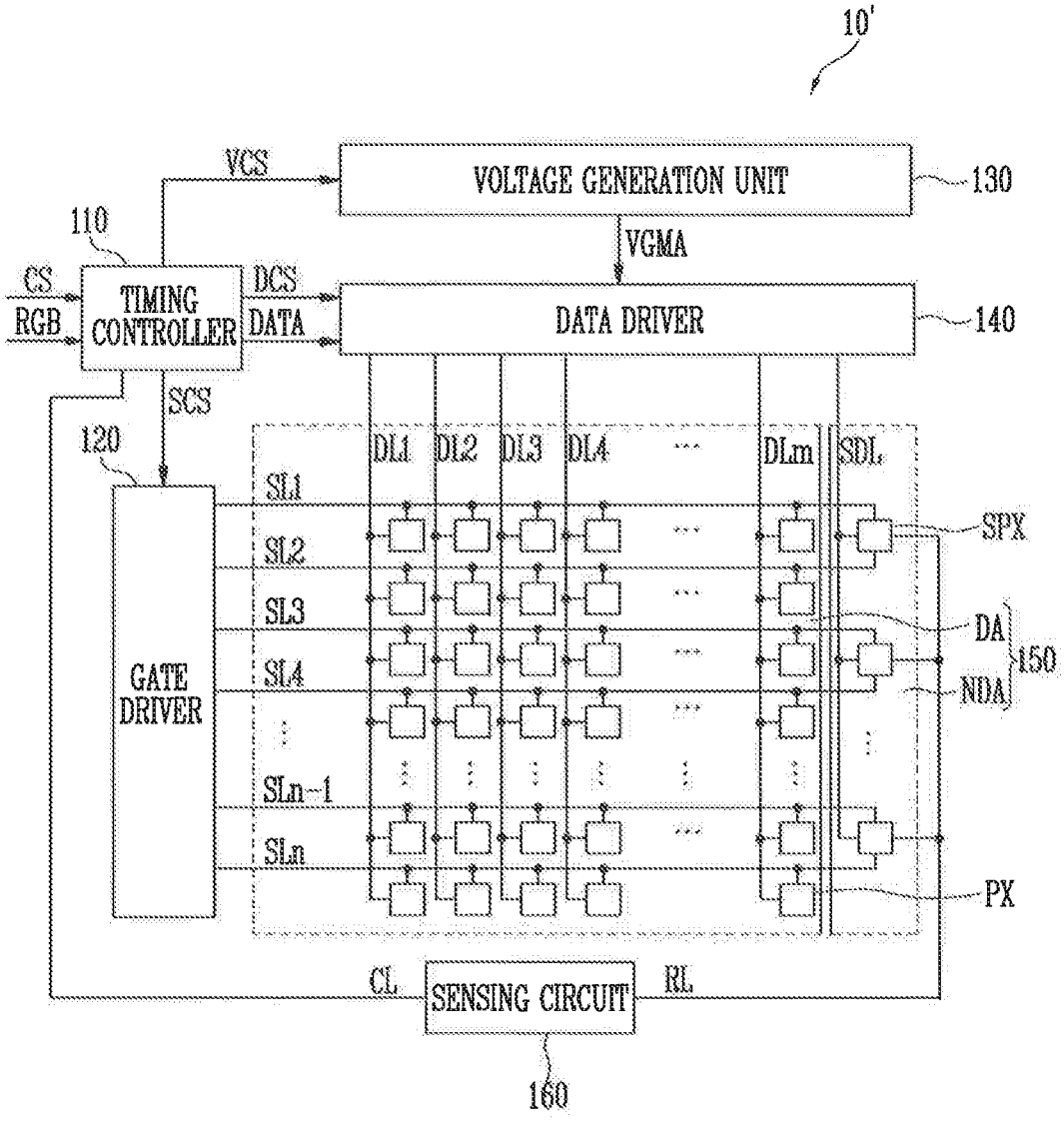
FIG. 10 is a block diagram schematically illustrating a display device according to an embodiment of the present inventive concept.
Figure 11:
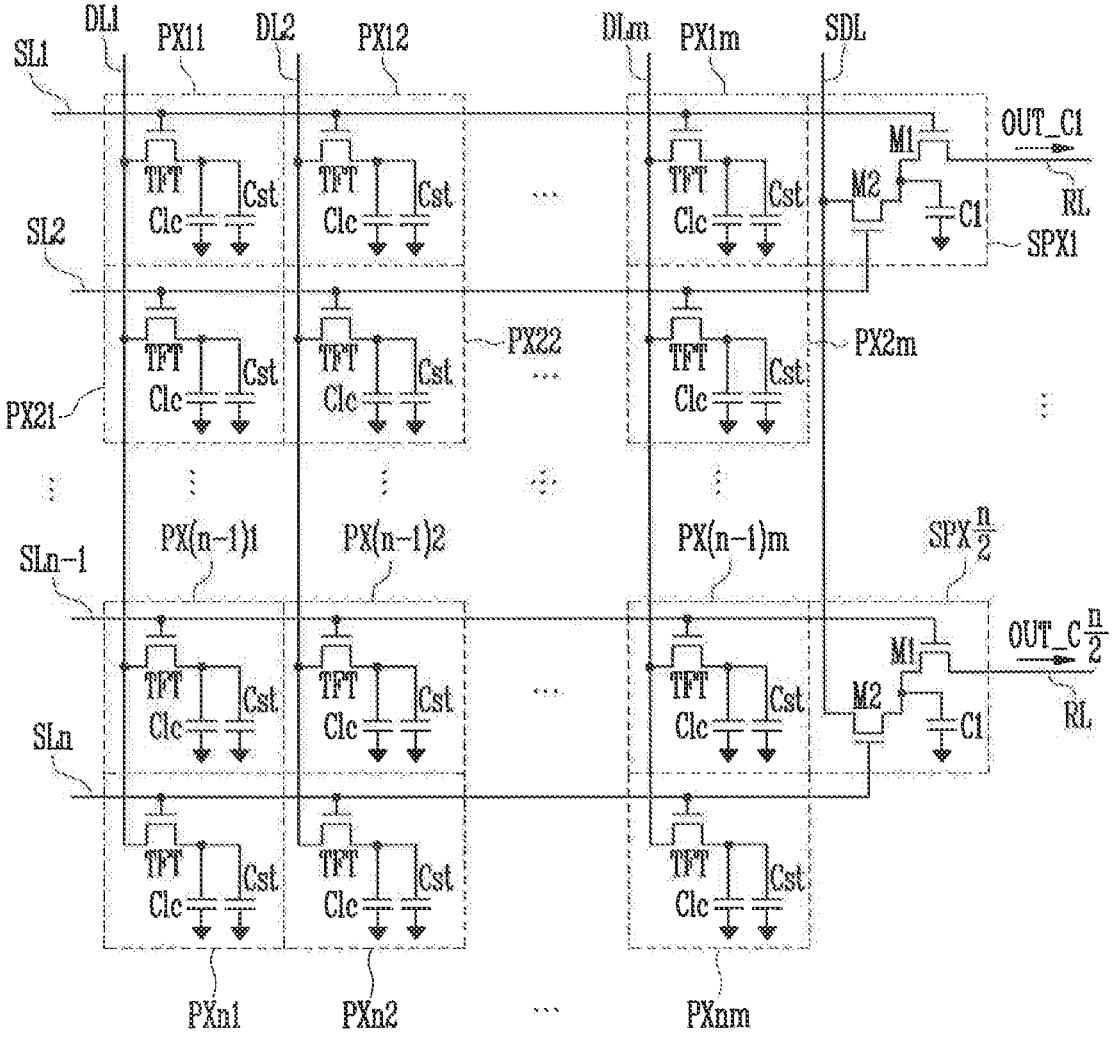
FIG. 11 is a diagram illustrating an arrangement of display pixels and auxiliary pixels according to an embodiment of the present inventive concept.
Figure 12:
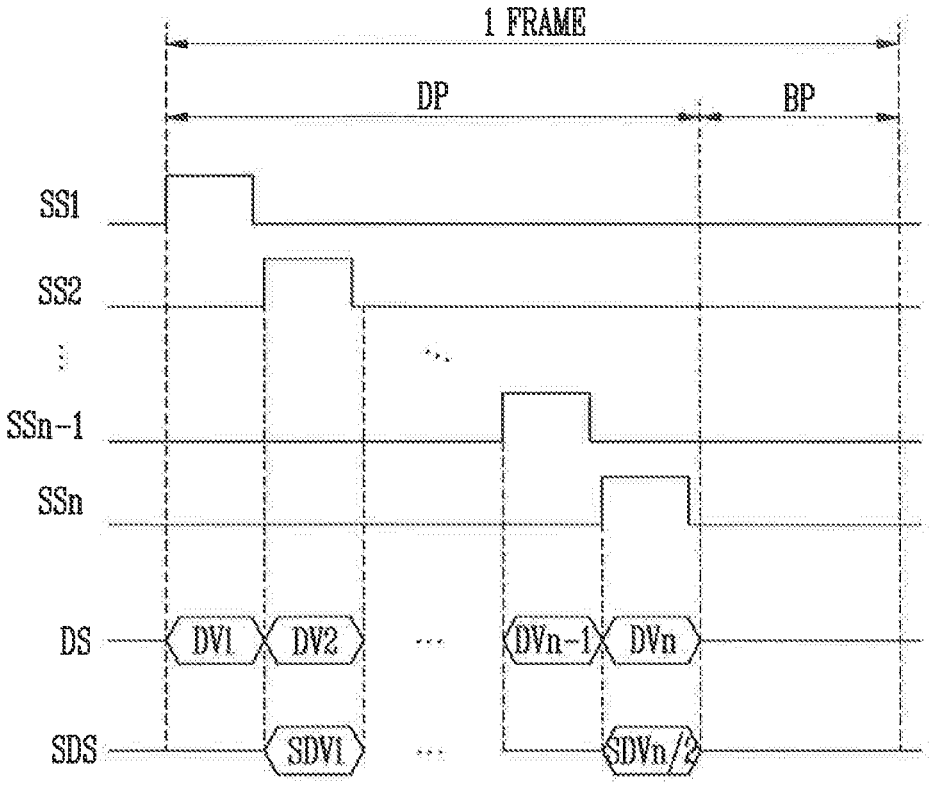
FIG. 12 is a timing diagram illustrating signals to be supplied to the display pixels and the auxiliary pixels shown in FIG. 11.

FIG. 10 is a block diagram schematically illustrating a display device 10' according to an embodiment of the present inventive concept. FIG. 11 is a diagram illustrating the arrangement of display pixels and auxiliary pixels according to an embodiment of the present disclosure. FIG. 12 is a timing diagram illustrating signals supplied to the display pixels and the auxiliary pixels shown in FIG. 11.

In FIGS. 10, 11 and 12, the following description will be focused on differences from the above-mentioned embodiments to avoid redundancy of explanation. In FIGS. 10, 11 and 12, components which are not separately explained in the following description may comply with that of the preceding embodiments. The same reference numerals will be used to designate the same components, and similar reference numerals will be used to designate similar components.

Referring now to FIG. 10, the display device 10' according to an embodiment of the present inventive concept may include a display unit 150, a timing controller 110, a gate driver 120, a voltage generation unit 130, a data driver 140, and a sensing circuit 160.

The display unit 150 may include a plurality of display pixels PX and a plurality of auxiliary pixels SPX.

The display pixels PX may be disposed on a display area DA, and coupled to data lines DL1 to DLm and gate lines SL1 to SLn.

The auxiliary pixels SPX may be disposed on a non-display area NDA of the display unit 150, and coupled to an auxiliary data line SDL and gate lines SL1 and SLn. The auxiliary pixels SPX may receive an auxiliary voltage and gate signals through the auxiliary data line SDL and the gate lines SL1 and SLn.

Each of the auxiliary pixels SPX may store the auxiliary voltage supplied through the auxiliary data line SDL. For example, each auxiliary pixel SPX may store the auxiliary voltage during a single frame or a single horizontal period.

Each of the auxiliary pixels may share a corresponding gate line with display pixels coupled to the same horizontal line. In other words, when a gate signal is supplied to the display pixels coupled to the same horizontal line, the gate signal may be simultaneously supplied to the corresponding auxiliary pixel.

Referring now to FIG. 11, each of display pixels PX11 to PXnm may include a thin film transistor TFT, a liquid crystal capacitor Clc and a storage capacitor Cst. The display pixels PX11 to PXnm may be arranged in the form of a matrix. Each of the display pixels PX11 to PXnm may receive a gate signal from any one of the gate lines SL1 to SLn, and receive a data signal from any one of the data lines DL1 to DLm.

Each of the auxiliary pixels SPX1 to SPX(n/2) may include a first transistor M1, a second transistor M2 and an auxiliary capacitor C1. The auxiliary pixels SPX1 to SPX (n/2) may be coupled to the gate lines SL1 and SLn and the auxiliary data line SDL. The transistors M1 and M2 may be thin film transistors TFT.

For example, a gate electrode of the first transistor M1 of the n/2-th auxiliary pixel SPX(n/2) may be coupled to an n−1-th gate line SLn−1, a first electrode thereof may be coupled to a first node N1, and a second electrode thereof may be electrically coupled to the sensing unit 160 through a read-out line RL.

A gate electrode of the second transistor M2 may be coupled to an n-th gate line SLn, a first electrode thereof may be coupled to the first node N1, and a second electrode thereof may be coupled to the auxiliary data line SDL.

The auxiliary capacitor C1 may be coupled to the first node N1, and store an auxiliary voltage. The auxiliary capacitor C1 may store an auxiliary voltage supplied to the corresponding one of the auxiliary pixels SPX1 to SPX(n/2) during a single frame or a single horizontal period.

As described above, the display pixels PX11 to PXnm and the auxiliary pixels SPX1 to SPX(n/2) may be disposed on the same horizontal lines. Consequently, the periods in which the display pixels PX11 to PXnm are supplied with gate signals may be the same as periods in which the auxiliary pixels SPX1 to SPX(n/2) are supplied with the gate signals.

Referring now to FIG. 12, there is shown first to n-th gate signals SS1 to SSn and a data signal DS which are supplied to the display pixels PX1*m* to PXnm disposed on an m-th pixel column during one frame 1 FRAME, and there are illustrated the first and n-th gate signals SS1 and SSn and an auxiliary voltage SDS which are supplied to the auxiliary pixels SPX1 to SPX(n/2) during one frame 1 FRAME.

The first to n-th gate signals SS1 to SSn may be supplied from the gate driver 120 (FIG. 1) through the respective first to n-th gate lines SL1 to SLn. The data signal DS may be supplied from the data driver 140 through m-th data line DLm. The auxiliary voltage SDS may be supplied from the data driver 140 through the auxiliary data line SDL.

The first to n-th gate signals SS1 to SSn include a voltage level that turns on the thin film transistors TFT of the display pixels PX1*m* to PXnm and the first and second transistors M1 and M2 of the auxiliary pixels SPX1 to SPX(n/2). Data voltages (DV1, DV2, . . . DVn) of the data signal DS to be supplied to the respective display pixels PX1*m* to PXnm may have the same value or different values. Auxiliary voltage levels SDV1 to SDV(n/2) of the auxiliary voltage SDS to be supplied to the respective auxiliary pixels SPX1 to SPX(n/2) may have the same value or different values.

Referring to FIG. 12, the one frame (1 FRAME) includes a data period DP in which the data signal DS is supplied to the display pixels PX1*m* to PXnm, and a blank period BP which is a pause period.

Hereinafter, the operation of the display pixels PX1*m* to PXnm and the auxiliary pixels SPX1 to SPX(n/2) will be described.

The display pixels PX1*m* to PXnm receive the data signal DS in response to the supply of the first to n-th gate signals SS1 to SSn during the data period DP.

Also, the auxiliary pixels SPX1 to SPX(n/2) receive the auxiliary voltage SDS from the data driver 140 during the data period DP.

By having the display pixels receive the data signals DS during the data period BP and also having the auxiliary pixels SPX1 to SPX(n/2), the auxiliary pixels SPX1 to SPX(n/2) may receive the auxiliary voltage SDS during a period that overlap the period for which the display pixels PX1*m* to PXnm are supplied with the data signal. This overlap may provide a more accurate way to determine whether the display pixels should be compensated by sensing a voltage of the auxiliary pixels, as a TFT leakage current can be detected in real time during a frame. In addition, the overlap may permit application of a compensation voltage to the display pixels to prevent a flicker.

According to an embodiment of the inventive concept, the display device 10' may perform an operation of compensating, using leakage current outputted from each of the auxiliary pixels SPX1 to SPX(n/2), for data signals for display pixels disposed on the corresponding horizontal lines.

For example, the sensing circuit 160 may generate auxiliary voltage information using leakage current outputted from the auxiliary pixel that is coupled to i-th (i is a natural number) and i+1-th gate lines. In the above-described manner, the display device 10' may compensate for a data signal to be supplied to the display pixels that are coupled to the i-th and i+1-th gate lines according to the auxiliary voltage information.

In other words, according to the auxiliary voltage information, the display device 10' may change the gradation of the image signals corresponding to the display pixels that are coupled to the i-th and i+1-th gate lines, or control the driving voltage to change the levels of the data signals to be supplied to the display pixels that are coupled to the i-th and i+1-th gate lines.

Figure 13:
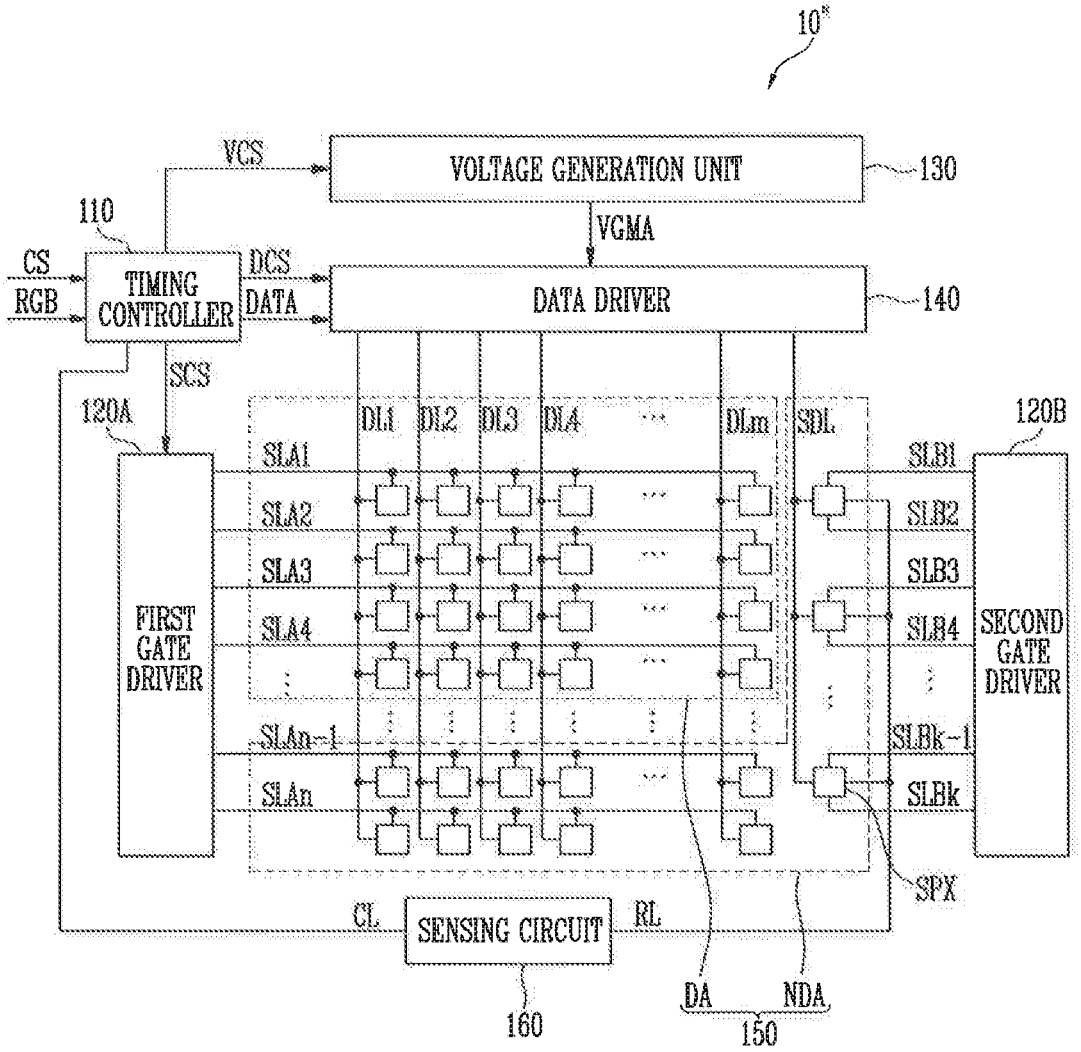
FIG. 13 is a block diagram schematically illustrating a display device according to an embodiment of the present inventive concept.
Figure 14:
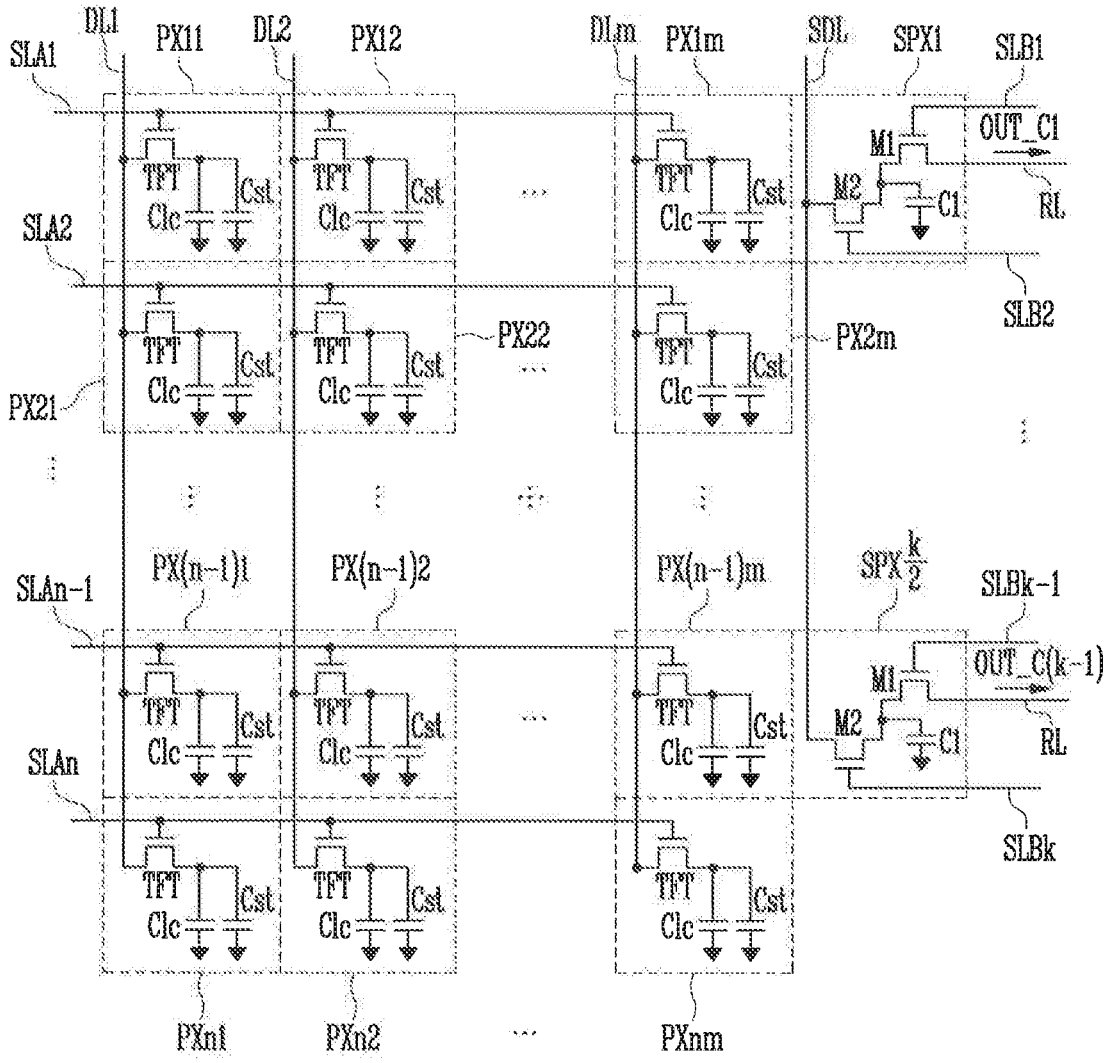
FIG. 14 is a diagram illustrating an arrangement of display pixels and auxiliary pixels according to an embodiment of the present inventive concept.

FIG. 13 is a block diagram schematically illustrating a display device 10" according to an embodiment of the present inventive concept. FIG. 14 is a diagram illustrating arrangement of display pixels PX and arrangement of auxiliary pixels SPX according to an embodiment of the present disclosure.

In FIGS. 13 and 14, the following description will be focused on differences from the above-mentioned embodiments to avoid redundancy of explanation. In FIGS. 13 and 14, components which are not separately explained in the following description may comply with that of the preceding embodiments. For example, in FIG. 13 there are two gate drivers shown. The same reference numerals will be used to designate the same components, and similar reference numerals will be used to designate similar components.

Referring to FIG. 13, the display device 10" according to an embodiment of the present inventive concept may include a display unit 150, a timing controller 110, first gate driver 120A and second gate drivers 120B, a voltage generation unit 130, a data driver 140, and a sensing circuit 160.

Display pixels PX may be coupled to data lines DL1 to DLm and first gate lines SLA1 to SLAn, and receive data signals and first gate signals through the data lines DL1 to DLm and the first gate lines SLA1 to SLAn.

Auxiliary pixels SPX may be coupled to an auxiliary data line SDL and second gate lines SLB1 to SLBk. The auxiliary pixels SPX may receive an auxiliary voltage and second gate signals through the auxiliary data line SDL and the second gate lines SLB1 and SLBk.

The first gate driver 120A may supply the first gate signals to the first gate lines SLA1 to SLAn in response to a gate control signal SCS. For example, the first gate driver 120A may sequentially supply the first gate signals to the first gate lines SLA1 to SLAn.

The second gate driver 120B may supply second gate signals to the second gate lines SLB1 to SLBk in response to a gate control signal SCS. For example, the second gate driver 120B may sequentially supply the second gate signals to the second gate lines SLB1 to SLBk.

A period for which the first gate driver 120A supplies the first gate signals may be equal to or different from a period in which the second gate driver 120B supplies the second gate signals.

Referring to FIG. 14, each of display pixels PX11 to PXnm may include a thin film transistor TFT, a liquid crystal capacitor Clc, and a storage capacitor Cst. The display pixels PX11 to PXnm may be arranged in matrix form. Each of the display pixels PX11 to PXnm may receive a first gate signal from any one of the first gate lines SLA1 to SLAn, and receive a data signal from any one of the data lines DL1 to DLm.

Each of the auxiliary pixels SPX1 to SPX(k/2) may include a first transistor M1, a second transistor M2, and an auxiliary capacitor C1. The auxiliary pixels SPX1 to SPX (k/2) may be coupled to the second gate lines SLB1 and SLBk and the auxiliary data line SDL.

For example, a gate electrode of the first transistor M1 of a k/2-th (k is a multiple of 2) auxiliary pixel SPX(k/2) may be coupled to a k−1-th second gate line SLBk−1, a first electrode thereof may be coupled to a first node (N1), and a second electrode thereof may be electrically coupled to the sensing unit 160 through a read-out line RL.

A gate electrode of the second transistor M2 may be coupled to a k-th second gate line SLBk, a first electrode thereof may be coupled to the first node (N1), and a second electrode thereof may be coupled to the auxiliary data line SDL.

The auxiliary capacitor C1 may be coupled to the first node (N1), and store an auxiliary voltage. The auxiliary capacitor C1 may store an auxiliary voltage supplied to the corresponding one of the auxiliary pixels SPX1 to SPX(k/2) during a single frame or a single horizontal period.

According to an embodiment of the present disclosure, the display pixels PX11 to PXnm and the auxiliary pixels SPX1 to SPX(k/2) may respectively receive different gate signals from the first gate driver 120A and second gate drivers 120B. The additional auxiliary pixels can permit compensation of the display pixels with enhanced accuracy.

Figure 15:
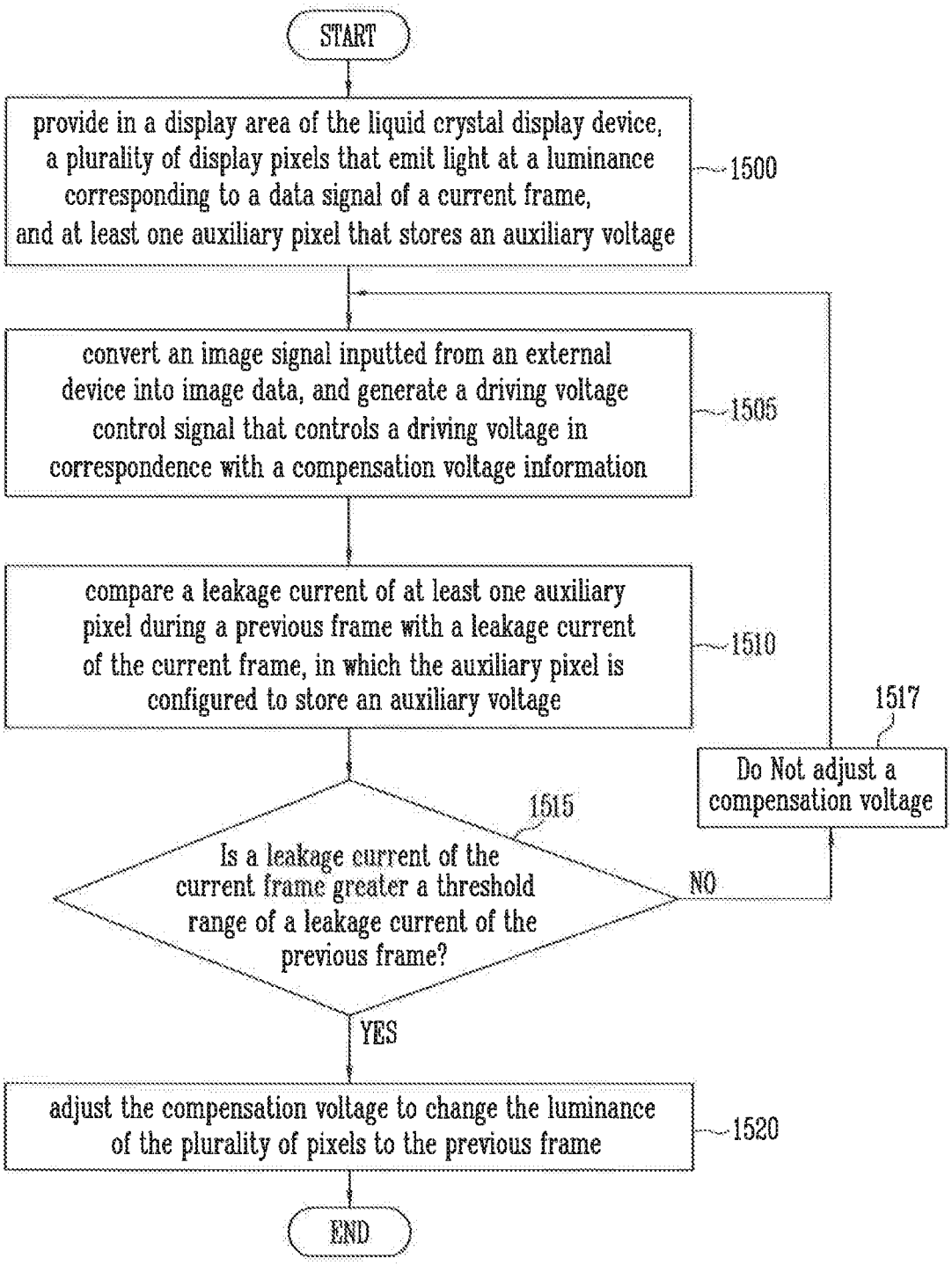
FIG. 15 is a flowchart illustrating an example of an operation of a method according to the inventive concept.

FIG. 15 is a flowchart illustrating a method of operation to prevent flicker according to the inventive concept. An artisan understands and appreciates that the method may be performed in various ways that are within the inventive concept.

At operation 1500, a plurality of display pixels are arranged in a display area of a liquid crystal display device, and at least one auxiliary pixel in one of a display area or non-display area. As discussed herein above, the at least one auxiliary pixel may be arranged in other areas of a display device, e.g., a side of a display panel.

At operation 1505, a timing controller converts an image signal input from an external device into image data. The timing controller also generates a driving voltage control signal that controls a driving voltage in correspondence with compensation voltage information provided by a sensing circuit.

At operation 1510, a leakage current of the at least one auxiliary pixel of a previous frame is compared with a leakage current of a current frame. This comparison may be performed by, for example, comparator circuitry, a micro-controller, etc. The auxiliary voltage of the auxiliary pixel can be measured and compared with a previous frame, or a reference value, to determine whether there is an increase in the leakage current.

At operation 1515, if, for example, a timing controller determines that the leakage current of the current frame is not greater than a leakage current of a previous frame (or a threshold), there is no adjusting of the compensation voltage. The operation may return to operation 1505 for the next frame or horizontal period.

However, if at operation 1515 it is determined that the leakage current is greater than the previous frame or greater than a threshold, the compensation voltage is adjusted to change the luminance of the plurality of display pixels to, for example, the previous frame. The method may then repeat at least operations 1505, 1510, and 1515 for the next frame, or may end.

Various embodiments of the present inventive concept may provide a display device in which since an optimal data signal corresponding to a change in an auxiliary voltage stored in an auxiliary pixel is provided to display pixels, each display pixel may emit light at a desired luminance even when some data is lost.

Embodiments of the inventive concept have been disclosed herein, and although certain terms are employed in this description, they are used and are to be interpreted in a generic and descriptive sense only and not for purpose of limitation. In some instances, as would be apparent to one of ordinary skill in the art as of the effective filing date of the present application, features, characteristics, and/or elements described in connection with a particular embodiment may be used singly or in combination with features, characteristics, and/or elements described in connection with other embodiments unless otherwise specifically indicated. Accordingly, it will be understood by those of ordinary skill in the art that various changes in form and details may be made without departing from the spirit and scope of the inventive concept as set forth in the following claims.

What is claimed is:

1. A display device comprising:

a plurality of display pixels configured to emit light at a luminance corresponding to a data signal;

at least one auxiliary pixel configured to store an auxiliary voltage;

a gate driver configured to supply a gate signal to the plurality of display pixels and the at least one auxiliary pixel;

a data driver configured to convert image data into the data signal using a reference gamma voltage, and supply an auxiliary voltage having a preset value to the at least one auxiliary pixel;

a sensing circuit configured to sense whether a change occurs in the preset value of the auxiliary voltage stored in the auxiliary pixel for a predetermined period, and to generate compensation voltage information;

a timing controller configured to convert an image signal inputted from an external device into the image data, and generate a driving voltage control signal that controls a driving voltage in correspondence with the compensation voltage information; and a voltage generator configured to generate a driving voltage corresponding to the driving voltage control signal received from the timing controller, and to generate the reference gamma voltage based on the driving voltage.

2. The display device according to claim 1, wherein the predetermined period comprises a per-frame basis.

3. The display device according to claim 2, wherein, when the compensation voltage information includes a difference value between a first auxiliary voltage measured during a current frame and a reference auxiliary voltage, the driving voltage control signal generated by the timing controller controls the voltage generator to increase the driving voltage in correspondence with the difference value.

4. The display device according to claim 2, wherein, when the compensation voltage information includes a difference value between a first auxiliary voltage measured during a current frame and a second auxiliary voltage measured during a preceding frame, and the first auxiliary voltage is less than the second auxiliary voltage, the driving voltage control signal generated by the timing controller controls the voltage generator to increase the driving voltage in correspondence with the difference value.

5. The display device according to claim 4, wherein the voltage generator generates an increased driving voltage for a subsequent frame.

6. The display device according to claim 1, wherein, when the compensation voltage information includes a difference value between a first auxiliary voltage measured during a current frame and a second auxiliary voltage measured during a preceding frame, the first auxiliary voltage is less than the second auxiliary voltage, and the difference value is greater than a threshold difference value, the driving voltage control signal generated by the timing controller controls the voltage generator to increase the driving voltage in correspondence with the difference value.

7. The display device according to claim 1, wherein the sensing circuit comprises:

an output sensor configured to measure the auxiliary voltage stored in the at least one auxiliary pixel using a leakage current outputted from the at least one auxiliary pixel; and a compensator configured to generate the compensation voltage information based on a change in the measured auxiliary voltage.

8. The display device according to claim 1, wherein the at least one auxiliary pixel comprises;

a first transistor including a gate electrode coupled to an i-th gate line, a first electrode coupled to a first node, and a second electrode electrically coupled to the sensing circuit through a read-out line;

a second transistor including a gate electrode coupled to an i+1-th gate line, a first electrode coupled to the first node, and a second electrode coupled to an auxiliary data line; and an auxiliary capacitor coupled to the first node and configured to store the auxiliary voltage.

9. The display device according to claim 8, wherein the auxiliary capacitor stores the auxiliary voltage supplied to the first, node from the auxiliary data line while the second transistor is turned on.

10. The display device according to claim 1, wherein the plurality of display pixels and the at least one auxiliary pixel are disposed on different horizontal lines.

11. The display device according to claim 1, wherein the gate driver comprises first and second gate drivers, and wherein the first gate driver is coupled to the plurality of display pixels through a first gate line, and the second gate driver is coupled to the at least one auxiliary pixel through a second gate line different from the first gate line.

12. The display device according to claim 1, wherein the plurality of display pixels are disposed on a display area in which an image is displayed, and the at least one auxiliary pixel is disposed on a non-display area in which an image is not displayed.

13. The display device according to claim 1, wherein a period in which the data signal is supplied to at least some of the plurality of display pixels does not overlap a period in which the auxiliary voltage is supplied to the at least one auxiliary pixel.

14. A display device comprising:

a plurality of display pixels configured to emit light at a luminance corresponding to a data signal;

at least one auxiliary pixel configured to store an auxiliary voltage;

a gate driver configured to supply a gate signal to the plurality of display pixels and the at least one auxiliary pixel;

a sensing circuit configured to sense a change in the auxiliary voltage stored in the at least one auxiliary pixel for each frame, and to generate compensation voltage information;

a timing controller configured to change a gradation of an image signal inputted from an external device according to the compensation voltage information generated by the sensing circuit, and to generate image data; and a data driver configured to convert the image data into the data signal, and supply an auxiliary voltage having a preset value to the at least one auxiliary pixel.

15. The display device according to claim 14, wherein the sensing circuit generates first auxiliary voltage information using an auxiliary pixel coupled to i-th and i+1-th gate lines, and wherein the timing controller generates the image data by changing a gradation of the image signal corresponding to the plurality of display pixels coupled to the i-th and gate lines according to the first auxiliary voltage information.

16. The display device according to claim 15, wherein the timing controller generates image data of an R_DATA, G_DATA and B_DATA having a changed gradation by changing bits of image signals R, G and B that are digital signals.

17. A method for preventing flicker in a liquid crystal display device, the method including:

providing in a display area of the liquid crystal display device, a plurality of display pixels that emit light at a luminance corresponding to a data signal of a current frame, and in at least one of a non-display area and display area of the liquid crystal display device, at least one auxiliary pixel that stores an auxiliary voltage;

converting an image signal inputted from an external device into image data, and generating a driving voltage control signal that controls a driving voltage in correspondence with a compensation voltage information provided by a sensing circuit that is connected at least with the at least one auxiliary pixel and a timing controller;

comparing a leakage current of at least one auxiliary pixel during a previous frame with a leakage current of the current frame, in which the auxiliary pixel is configured to store an auxiliary voltage; and adjusting a compensation voltage that is applied to a voltage unit generator, when the comparing of the leakage current indicates that the luminance of the plurality of the display pixels is outside of a threshold range.

18. The method according to claim 17, wherein the adjusting of the compensation voltage occurs in real time during a frame.

19. The method according to claim 17, wherein the compensation voltage restores the luminance of the plurality of display pixels to a value initially specified by the data signal of the current frame.

20. A non-transitory computer readable storage medium including executable code when executed by a processor of a liquid crystal display device performs the method of claim 17.

* * * * *